US011293639B2

(12) United States Patent
Viano

(10) Patent No.: US 11,293,639 B2
(45) Date of Patent: Apr. 5, 2022

(54) HEATSHIELD FOR A GAS TURBINE ENGINE

(71) Applicant: Siemens Energy Global GmbH & Co. KG, Munich (DE)

(72) Inventor: Andrea Viano, Metheringham (GB)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 48 days.

(21) Appl. No.: 16/766,016

(22) PCT Filed: Nov. 1, 2018

(86) PCT No.: PCT/EP2018/079954

§ 371 (c)(1),
(2) Date: May 21, 2020

(87) PCT Pub. No.: WO2019/110210

PCT Pub. Date: Jun. 13, 2019

(65) Prior Publication Data

US 2020/0292173 A1 Sep. 17, 2020

(30) Foreign Application Priority Data

Dec. 4, 2017 (GB) ..... 1720121

(51) Int. Cl.
*F23R 3/08* (2006.01)
*F01D 25/12* (2006.01)
(Continued)

(52) U.S. Cl.
CPC ..... *F23R 3/08* (2013.01); *F01D 25/12* (2013.01); *F23R 3/002* (2013.01);
(Continued)

(58) Field of Classification Search
CPC ..... F01D 25/12; F01D 11/005; F01D 11/08; F01D 9/04; F01D 11/24; F01D 11/008;
(Continued)

(56) References Cited

U.S. PATENT DOCUMENTS 6,116,852 A 9/2000 Pierre et al.
7,874,792 B2 * 1/2011 Tholen ..... B22C 9/10 415/173.1

(Continued)

FOREIGN PATENT DOCUMENTS

EP 0558540 A1 9/1993
EP 2397653 A1 12/2011

(Continued)

*Primary Examiner* — Eric J Zamora Alvarez

(57) ABSTRACT

A heat shield for a gas turbine engine has a main body having a first and second surface, the first surface exposed to a hot working gas, a plurality of walls upstanding from the second surface and an impingement plate. The impingement plate is on top of at least one wall and forms a chamber and has an array of impingement holes. At least one pair of divider walls are formed within the chamber and extend between the impingement plate and the second surface. The first divider wall extends from a first wall towards a second wall, the second divider wall extends from the second wall towards the first wall. The first and second divider walls both extend such that there is no clear line of sight in a perpendicular direction to the first divider wall and/or second divider wall and are spaced apart with respect to the perpendicular direction.

18 Claims, 4 Drawing Sheets

(51) Int. Cl.

| | |
|---|---|
| ***F23R 3/00*** | (2006.01) |
| ***F01D 11/08*** | (2006.01) |
| ***F01D 11/24*** | (2006.01) |
| ***F02C 7/18*** | (2006.01) |

(52) U.S. Cl.
CPC ..... *F05D 2240/11* (2013.01); *F05D 2240/15* (2013.01); *F05D 2260/201* (2013.01); *F23R 2900/03043* (2013.01); *F23R 2900/03044* (2013.01)

(58) Field of Classification Search
CPC ..... F01D 25/24; F01D 5/143; F01D 9/023; F01D 11/006; F05D 2220/32; F05D 2240/11; F05D 2240/55; F05D 2240/57; F05D 2240/15; F05D 2260/2212; F05D 2260/2214; F05D 2260/20; F05D 2260/201; F05D 2260/202; F05D 2260/221; F04D 29/584; F02C 7/28; F23R 3/08; F23R 3/002; F23R 2900/03043; F23R 2900/03044
See application file for complete search history.

(56) References Cited

U.S. PATENT DOCUMENTS

| | | | |
|---|---|---|---|
| 8,123,466 | B2 | 2/2012 | Pietraszkiewicz et al. |
| 8,668,440 | B2 * | 3/2014 | Butler ..... F01D 9/041 415/116 |
| 9,500,095 | B2 | 11/2016 | Pietrobon et al. |
| 9,702,560 | B2 | 7/2017 | Grendel et al. |
| 2007/0041827 | A1 | 2/2007 | Camus |
| 2007/0237647 | A1 | 10/2007 | Bulgrin et al. |
| 2013/0209217 | A1 | 8/2013 | Butler et al. |
| 2016/0061113 | A1 | 3/2016 | Romanov et al. |

FOREIGN PATENT DOCUMENTS

| | | | |
|---|---|---|---|
| EP | 2570613 | A2 | 3/2013 |
| EP | 3133254 | A1 | 2/2017 |
| FR | 2316440 | A1 | 1/1977 |
| RU | 2217599 | C2 | 11/2003 |
| RU | 2635742 | C2 | 11/2017 |
| WO | 9209850 | A1 | 6/1992 |

* cited by examiner

HEATSHIELD FOR A GAS TURBINE ENGINE

CROSS REFERENCE TO RELATED APPLICATIONS

This application is the US National Stage of International Application No. PCT/EP2018/079954 filed 1 Nov. 2018, and claims the benefit thereof. The International Application claims the benefit of United Kingdom Application No. GB 1720121.1 filed 4 Dec. 2017. All of the applications are incorporated by reference herein in their entirety.

FIELD OF INVENTION

The present invention relates to a heat shield that may be used in a gas turbine engine and in particular a cooling arrangement to improve cooling of the heat shield.

BACKGROUND OF INVENTION

A heat shield is a component which protects another component such as a casing from the hot working gases in a combustor or a turbine of a gas turbine engine for example. The heat shield is exposed to very high temperatures, usually combustion gases, and to help resist the high temperatures the heat shield is provided with a cooling system. The cooling system receives pressurised air or coolant from a compressor and uses the air to impinge on the heat shield to remove heat therefrom and to form film cooling on the surface of the heat shield exposed to the hot working gases.

U.S. Pat. No. 9,145,789B2 discloses an impingement plate that is co-operable with a shroud assembly. The shroud assembly includes an outer shroud and plural inner shrouds with seals between the plural inner shrouds, respectively. The impingement plate includes a trailing edge portion, a leading edge portion and a mid portion between the trailing edge portion and the leading edge portion. A plurality of impingement holes are formed across an area of the impingement plate, and a cooling and damping section includes at least one channel that is shaped to accelerate cooling flow through the impingement plate.

EP2918780 discloses a component comprising a component wall that is arranged to flow a hot gas along the outer side. An impingement cooling wall having a number of grid-like arranged impingement cooling openings is spaced at an inner side opposite to the outer side. Several guide elements for guiding a cooling medium through the impingement cooling openings are arranged on the inner sides. The guide elements include a contour in a form of a curved droplet with a thinner end and a thicker end. Enhanced cooling is achieved. The cooling effect is increased, since the suction side is formed in the guide elements of the acceleration effect of the coolant flow. The unwanted cross-flows are reduced to adjacent impingement cooling openings.

US2014/0271105 discloses a segmented shroud ring that surrounds a circumferential array of blades of a gas turbine engine rotor. The shroud ring has a plurality of shroud segments disposed circumferentially one adjacent to another. The circumferentially adjacent shroud segments have confronting sides defining an inter-segment gap therebetween. The inter-segment gaps are sealed by a sealing band mounted to the radially outer surface of the segmented shroud ring so as to extend across the inter-segment gaps around the full circumference of the shroud ring. Impingement jet holes may be defined in the sealing band for cooling the shroud segments.

US2014/0116059 discloses a hot gas segment arrangement, especially for a combustion chamber of a gas turbine, that includes at least one hot gas segment, which is removably mounted on a carrier, and is subjected at its outside to hot gas and impingement-cooled at its inside. An impingement plate with a plurality of distributed impingement holes is arranged in a distance at the inside of the impingement plate. A cooling air supply means is provided for loading the impingement plate with pressurized cooling air in order to generate, through the impingement holes, jets of cooling air, which impinge on the inside of the hot gas segment. The cooling efficiency and lifetime are increased by the impingement plate being part of a closed receptacle, which is supplied with the pressurized cooling air, and by the receptacle with the impingement plate being mounted on the carrier independently of the hot gas segment.

U.S. Pat. No. 7,704,039B1 discloses a blade outer air seal (BOAS) for use in a gas turbine engine. The BOAS including a plurality of first diffusion and impingement cooling air cavities separated by stiffener ribs, each diffusion and impingement cavity being connected to a cooling air supply cavity through a first metering and impingement hole. Each diffusion and impingement cavity is connected to a plurality of trenched diffusion slots that open onto the surface of the BOAS and form a series of V-shaped slots. A plurality of second metering and impingement holes connect each slot to the respective first diffusion and impingement cavity. The trenched diffusion slots are angularly offset from a normal direction to the BOAS surface, and the second metering and impingement holes are offset at about 90 degrees from the slots so that both diffusion and impingement cooling occurs within the slots. The array of separated diffusion and impingement cavities and metering holes allow for the cooling flows and pressures to be regulated for each area of the BOAS.

U.S. Pat. No. 7,597,533B1 discloses a blade outer air seal (BOAS) used in a gas turbine engine. The BOAS including a metering plate with metering holes and an impingement plate with impingement holes, the metering plate and impingement plate forming a plurality of separate diffusion cavities forming a grid. A porous metallic plate is bonded to the underside of the impingement plate and has a plurality of cooling channels extending from the leading edge to the trailing edge of the BOAS. Cooling air from the blade ring carrier is metered through the metering holes and into the diffusion cavities, and then passes through a plurality of impingement holes and into a cooling channel, to be discharged out the trailing edge side of the BOAS. Inter-segment cooling holes also pass cooling air out to the sides of the BOAS.

US2012/0063891A1 discloses a cooled component for a gas turbine, which by an outer side of a wall delimits hot gas passage of the gas turbine and on an inner side has a device for impingement cooling. The impingement cooling device can include a multiplicity of impingement cooling chambers which are arranged next to each other, operate in parallel, are covered by impingement cooling plates which are equipped with impingement cooling holes, and are impinged upon by cooling air during operation.

It remains an objective to provide improved cooling to gas turbine components which reduces temperature gradients, reduces absolute temperatures and minimises the use of cooling air.

SUMMARY OF INVENTION

To address the problems of known coating systems there is provided a heat shield for a gas turbine engine. The heat shield comprising a main body having a first surface and a second surface, the first surface being exposed to a hot working gas in use, a plurality of walls upstanding from the second surface, and an impingement plate. The impingement plate is attached to at least one wall of the plurality of walls and forms a chamber with the second surface and plurality of walls and comprises an array of impingement holes. At least one pair of divider walls comprising a first divider wall and a second divider wall formed within the chamber and extending between the impingement plate and the second surface. The first divider wall having a length that extends from a first wall of the plurality of walls towards a second wall, the second wall opposing the first wall, the second divider wall having a length that extends from the second wall towards the first wall. The first divider wall and second divider wall both extend such that they overlap one another viewed in a perpendicular direction to the first divider wall and/or second divider wall and the first divider wall and second divider wall are spaced apart with respect to the perpendicular direction. The overlap is greater than 0% and less than 80% of the chamber in the direction of the length of the first and/or second divider walls.

The first divider wall may be attached to the impingement plate or the second surface and/or the second divider wall is attached to the impingement plate or the second surface.

The first divider wall and the second divider wall may each extend between 10% and 90%, advantageously 15% and 85%, of the chamber in the direction of the length of the first and second divider walls.

The overlap is greater than 40% and less than 80% of the chamber in the direction of the length of the first and/or second divider walls.

The first divider wall and the second divider wall may be parallel to one another.

The first divider wall and the second divider wall may be angled with respect to one another.

The heat shield may comprise two pairs of divider walls.

One of the plurality of walls may be an upstream wall having lateral ends and one of the first divider wall and the second divider wall extend from the upstream wall, wherein the or each pair of divider walls are located within 30% of the length of the upstream wall from one or each of the lateral ends.

The at least one pair of divider walls may divide the chamber into at least a first lateral zone and a central zone, the array of impingement holes has at least a first set of impingement holes opening into the first lateral zone and a second set of impingement holes opening into the central zone, the first set of impingement holes has a different arrangement of impingement holes compared to the second set of impingement holes, the different arrangement of impingement holes provides a different cooling effect.

The plurality of walls has at least one lateral wall and the first lateral zone is located immediately adjacent to the lateral wall and the first lateral zone occupies up to 25% of the second surface within the chamber.

A second pair of divider walls may divide the chamber into a second lateral zone, the array of impingement holes has third set of impingement holes opening into second lateral zone, the third set of impingement holes has a different arrangement of impingement holes compared to at least the second set of impingement holes, the different arrangement of impingement holes provides a different cooling effect.

The different arrangements of impingement holes may comprise any one or more of the group comprising different density of impingement holes and different cross-sectional area of impingement holes.

The heat shield has a centre line, the at least one divider wall of at least one pair of divider walls is angled relative to the centre line, advantageously $\alpha$ is between +25° and −25°, more advantageously $\alpha$ is between +15° and −15° and most advantageously $\alpha$ is between +15° and 0°.

The first and/or second divider walls extend the full distance from the impingement plate to the second surface such that there are no gaps between the first and/or second divider walls and the impingement plate and/or the second surface.

The heat shield may be at least a part of any one or more of a component of a gas turbine engine and advantageously a circumferential segment or a blade outer air seal (BOAS), a shroud of a turbine system, a tile or a heat shield of a wall of the combustor system, a platform or shroud of a blade or vane.

BRIEF DESCRIPTION OF THE DRAWINGS

The above mentioned attributes and other features and advantages of this invention and the manner of attaining them will become more apparent and the invention itself will be better understood by reference to the following description of embodiments of the invention taken in conjunction with the accompanying drawings, wherein.

DETAILED DESCRIPTION OF INVENTION

Figure 1:
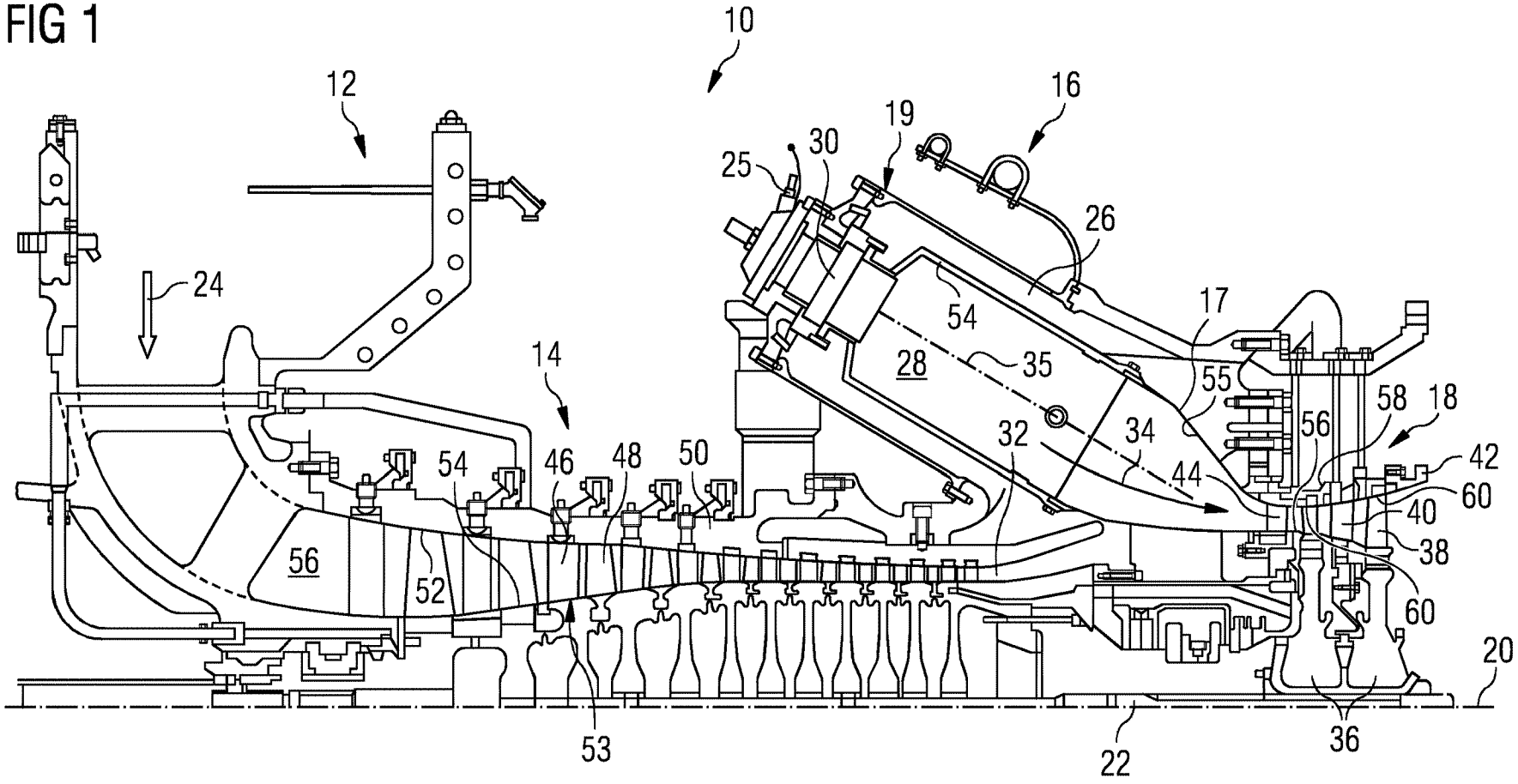
FIG. 1 shows part of a turbine engine in a sectional view and in which the present heat shield is incorporated.

FIG. 1 shows an example of a gas turbine engine 10 in a sectional view. The gas turbine engine 10 comprises, in flow series, an inlet 12, a compressor section 14, a combustor section 16 and a turbine section 18 which are generally arranged in flow series and generally about and along the direction of a longitudinal or rotational axis 20. The gas turbine engine 10 further comprises a shaft 22 which is rotatable about the rotational axis 20 and which extends longitudinally through the gas turbine engine 10. The shaft 22 drivingly connects the turbine section 18 to the compressor section 14.

In operation of the gas turbine engine 10, air 24, which is taken in through the air inlet 12 is compressed by the compressor section 14 and delivered to the combustion section or burner section 16. The burner section 16 comprises a burner plenum 26, one or more combustion chambers 28 and at least one burner 30 fixed to each combustion chamber 28. The combustion chambers 28 and the burners 30 are located inside the burner plenum 26. The compressed air passing through the compressor 14 enters a diffuser 32 and is discharged from the diffuser 32 into the burner plenum 26 from where a portion of the air enters the burner 30 and is mixed with a gaseous and/or liquid fuel. The air/fuel mixture is then burned and the combustion gas 34 or working gas from the combustion is channelled through the combustion chamber 28 to the turbine section 18 via a transition duct 17.

This exemplary gas turbine engine 10 has a cannular combustor section arrangement 16, which is constituted by an annular array of combustor cans 19 each having the burner 30 and the combustion chamber 28, the transition duct 17 has a generally circular inlet that interfaces with the combustor chamber 28 and an outlet in the form of an annular segment. An annular array of transition duct outlets form an annulus for channeling the combustion gases to the turbine 18. In other examples, the combustor section 16 may be an annular combustor as known in the art.

The turbine section 18 comprises a number of blade carrying discs 36 attached to the shaft 22. In the present example, two discs 36 each carry an annular array of turbine blades 38. However, the number of blade carrying discs could be different, i.e. only one disc or more than two discs. In addition, guiding vanes 40, which are fixed to a stator 42 of the gas turbine engine 10, are disposed between the stages of annular arrays of turbine blades 38. Between the exit of the combustion chamber 28 and the leading turbine blades 38 inlet guiding vanes 44 are provided and turn the flow of working gas onto the turbine blades 38.

The combustion gas from the combustion chamber 28 enters the turbine section 18 and drives the turbine blades 38 which in turn rotate the shaft 22. The guiding vanes 40, 44 serve to optimise the angle of the combustion or working gas on the turbine blades 38.

The turbine section 18 drives the compressor section 14. The compressor section 14 comprises an axial series of vane stages 46 and rotor blade stages 48. The rotor blade stages 48 comprise a rotor disc supporting an annular array of blades. The compressor section 14 also comprises a casing 50 that surrounds the rotor stages and supports the vane stages 46. The guide vane stages include an annular array of radially extending vanes that are mounted to the casing 50. The vanes are provided to present gas flow at an optimal angle for the blades at a given engine operational point. Some of the guide vane stages have variable vanes, where the angle of the vanes, about their own longitudinal axis, can be adjusted for angle according to air flow characteristics that can occur at different engine operations conditions.

The casing 50 defines a radially outer surface 52 of the passage 56 of the compressor 14. A radially inner surface 54 of the passage 56 is at least partly defined by a rotor drum 53 of the rotor which is partly defined by the annular array of blades 48.

The turbine section 18 further comprises a casing 58 and an annular array of heat shields 60 mounted to the casing 58 and partly defining a working gas path through the turbine section. The heat shields 60 are mounted radially outwardly of the rotor blades 38. In other gas turbine engines, the heat shields 60 may be mounted between annular arrays of rotor blades 38 and/or may be mounted on the radially inner casing 56.

The present invention is described with reference to the above exemplary turbine engine having a single shaft or spool connecting a single, multi-stage compressor and a single, one or more stage turbine. However, it should be appreciated that the present invention is equally applicable to two or three shaft engines and which can be used for industrial, aero or marine applications.

The terms upstream and downstream refer to the flow direction of the airflow and/or working gas flow through the engine unless otherwise stated. The terms forward and rearward refer to the general flow of gas through the engine. The terms axial, radial and circumferential are made with reference to the rotational axis 20 of the engine.

The term 'heat shield' is used to denote not only a heat shield as described herein, but also components such as —a circumferential segment or a blade outer air seal (BOAS) or a shroud of a turbine system 18 of the gas turbine engine 10, —a tile or a heat shield of a wall 54 of the combustor system 16 of a gas turbine engine 10, —a platform or shroud of a blade or vane 38, 44 of the gas turbine engine 10. When applied to a blade or vane either or both the radially inner and radially outer platform or shroud may incorporate the present heat shield configuration. The heat shield is described below with reference to a radially outer circumferential segment of a turbine that defines part of the working gas washed surface. Where the heat shield is applied to a radially inner platform or other component the terms radially inner and radially outer may be transposed.

The present heat shield 60 will now be described with reference to FIGS. 2 to 5.

Figure 2:
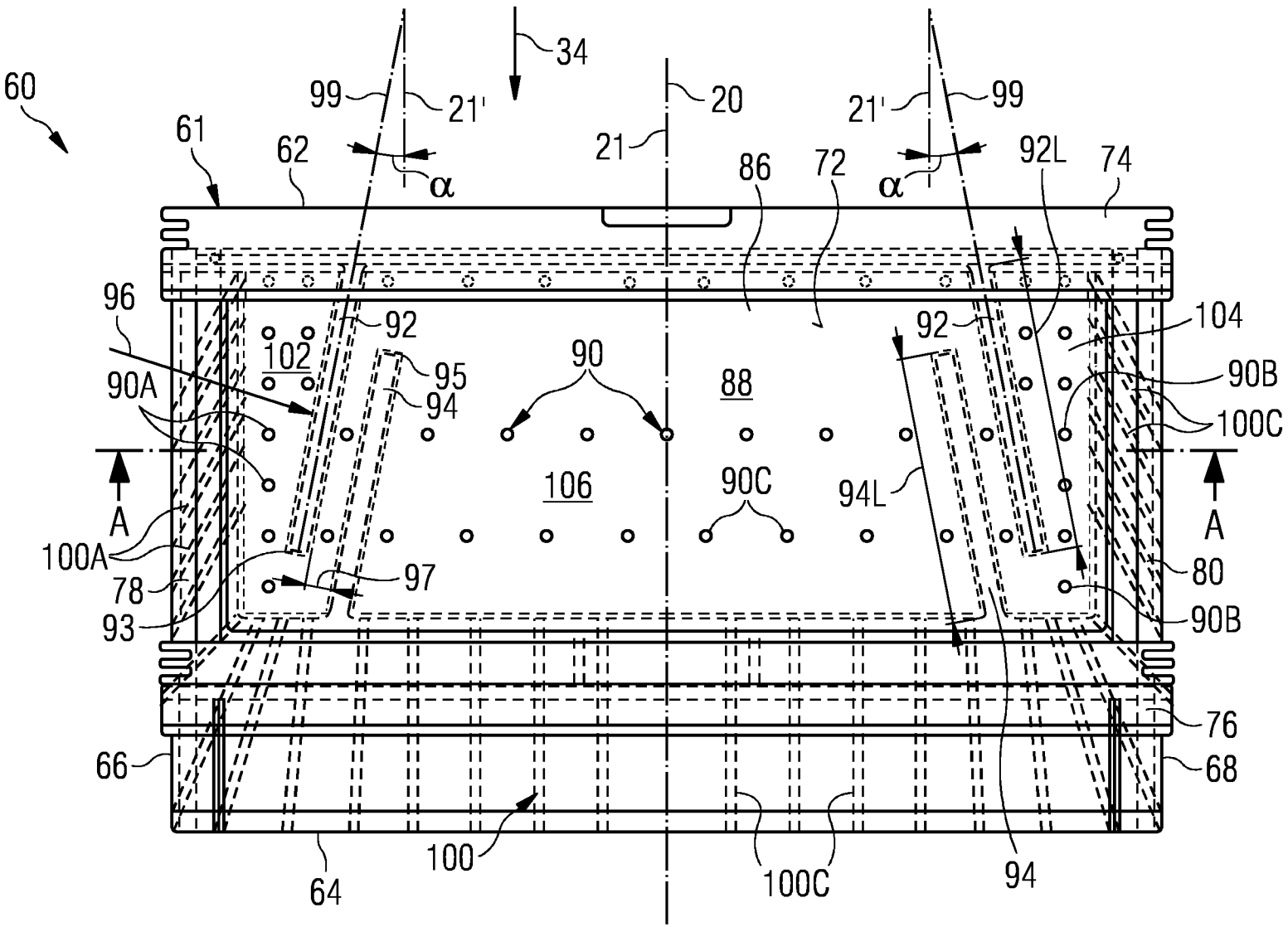
FIG. 2 is a view on the present heat shield looking radially inwardly and with dashed lines showing hidden features, the heat shield comprises an impingement plate having an array of impingement holes.
Figure 3:
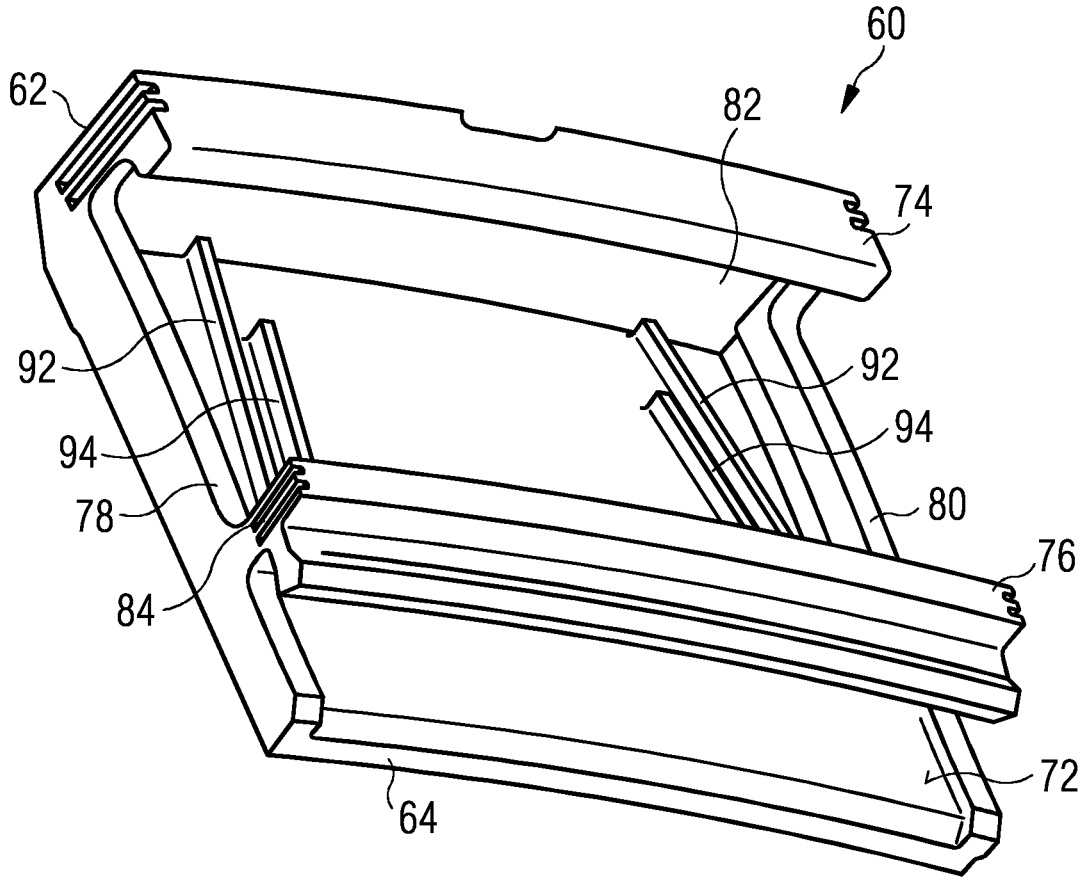
FIG. 3 is a perspective view on the present heat shield looking radially inwardly and axially forwardly; the impingement plate has been removed.
Figure 4:
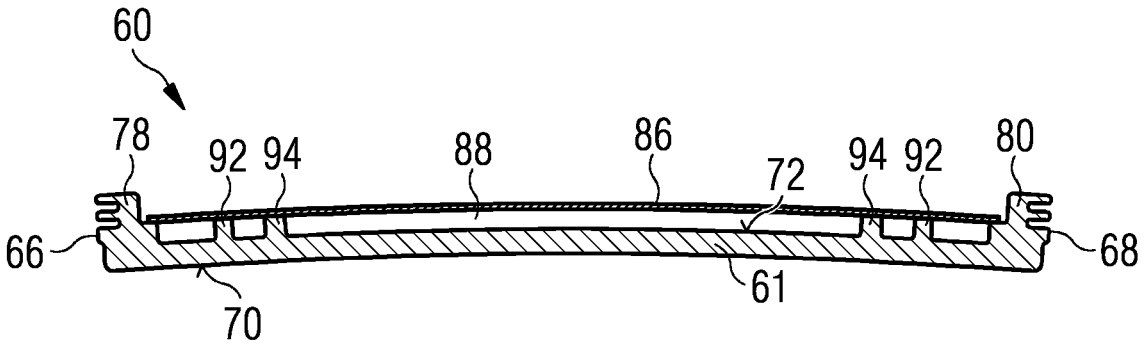
FIG. 4 is a cross-section A-A in FIG. 2 of the present heat shield.

Referring to FIGS. 2, 3 and 4, the heat shield 60 is a circumferential segment of an annular array of circumferential segments that form part of the gas washed outer surface of the gas path through the turbine section 18. The heat shield 60 is located radially outwardly of rotating blades 38 and forms a tip gap therebetween.

The heat shield 60 has a main body 61, a leading edge 62, a trailing edge 64 and to the left and to the right lateral edges 66, 68 respectively. When installed in a gas turbine engine immediately and circumferentially adjacent heat shields 60 may abut or be in close proximity to one another such that one left lateral edge 66 is facing one right lateral edge 68 and a gap may exist therebetween. The heat shield 60 has a first surface or gas washed surface 70, which is also a radially inner surface and that partly defines the radially outer gas washed surface of the gas path in the turbine section 18. The gas washed surface 70 may also be referred to as the hot side, that being subject to the hot working gases flowing through the gas path. The heat shield 60 has a second surface or cold side or surface 72 which is a radially outer surface relative to the hot gas flow.

The heat shield 60 is mounted to the casing 58 by a front hook or hanger 74 and a rear hook or hanger 76. The front hook 74 and the rear hook 76 engage with corresponding features on the casing 50. Other or additional securing means for securing the heat shield to the casing 50 or other supporting structure may be provided as known in the art.

The heat shield 60 has a centre-line 21 which when viewed radially inwardly towards the rotational axis 20 of the gas turbine 10 is parallel to the rotational axis 20. The heat shield 60 is generally symmetrical about its centre-line 21. The heat shield 60 is generally arcuate when viewed in FIG. 4 (along axis 21) and its curvature is that of part of the circumferential surface of the array of heat shields 60 that forms the gas washed surface of the turbine section 18.

The heat shield 60 has lateral walls 78, 80 and hook walls 82, 84. The hook walls 82, 84 are part of the front hook 74 and rear hook 76 respectively. The lateral walls 78, 80 and the hook walls 82, 84 are referred to generally as 'walls', thus the heat shield 60 has a plurality of walls and which are upstanding from the second surface 72.

The heat shield 60 further comprises an impingement plate 86. The impingement plate 86 comprises an array of impingement holes 90. In this exemplary embodiment, the impingement plate 86 is located on the cold side 72 of the heat shield 60 or radially outwardly of the heat shield 60. The impingement plate 86 is generally situated and sized to cover over most of the second surface 72, bounded by the walls 78, 80, 82, 84 a distance such that impingement jets of cooling fluid impinge on the second surface 72 in an optimal manner. The impingement plate 86 is attached to and advantageously is located on top of at least one wall 78, 80, 82, 84 and which is advantageously one or both of the lateral walls 78 and 80. The impingement plate 86, the walls 78, 80, 74, 76 and the second surface 72 form a chamber 88. The impingement plate 86 is braised or welded on to the walls 78, 80, 82, 84 of the heat shield 60 although other arrangements to attach or methods of attaching are possible. Ideally, the impingement plate 86 is sealed against the walls 78, 80, 82, 84 to prevent egress of the coolant from the chamber and which could adversely affect the pressure of the coolant and therefore where it is desired to flow.

The heat shield 60 further comprises at least one pair of divider walls 92, 94 comprising a first divider wall 92 and a second divider wall 94 formed within the chamber 88 and extending between the impingement plate 86 and the second surface 72. As seen in FIGS. 2, 3 and 4 there are two pairs of divider walls and the two pairs are symmetrically disposed about the centre-line 21 of the heat shield 60. In other examples, the two pairs of divider walls 92, 94 and any additional pairs of divider walls may be non-symmetrical. The divider walls 92, 94 are integrally formed or manufactured with the heat shield 60 by casting, additive manufacturing or other technique.

Alternatively, the divider walls 92, 94 are integrally formed or manufactured with the impingement plate 86 by casting, additive manufacturing or other technique. Integrally forming at least one of the divider walls 92, 94 with the impingement plate 86 would allow simple and be easy modifications to the configuration of the divider walls to be tested to find the best configuration, in other words impingement plates 86 with different divider wall configurations may be manufactured cheaply yet applied to the same base design of heat shield. Further, where the heat shield is used in gas turbine engines with different power ratings, impingement plates having different divider wall configurations can be easily implemented. In addition to the different divider wall configurations the impingement hole sizes and/or locations and/or densities can be easily adjusted for different applications including engine upgrades where combustion gas temperatures are higher.

The first and/or second divider walls 92, 94 extend the full distance from the impingement plate 86 to the second surface or vice versa such that there are no gaps between the first and/or second divider walls 92, 94 and the impingement plate 86 and/or the second surface 72. Therefore, it is intended that there are no gaps for coolant over the divider walls 92, 94 and instead only around the free ends of the divider walls 92, 94.

The first divider wall 92 is located laterally or circumferentially outside the second divider wall 94, that is to say it is located further away from the centre-line 21 than the second divider wall 94 or nearer the lateral edges 66, 68 than the second divider wall 94. The first divider wall 92 has a length that extends from a first wall 74 of the plurality of walls towards a second wall 76, but does not touch the second wall 76. The second wall 76 opposes the first wall 74 across the chamber 88. The second divider wall 94 has a length that extends from the second wall 76 towards the first wall 74. In this example, the first wall is part of the front hook 74 and the second wall is part of the rear hook 76. It should be noted that the first wall and the second wall are not required to be part of a hook feature, but in this example it is convenient that they are.

The first divider wall 92 and second divider wall 94 both extend such that there is no clear line of sight in a perpendicular direction, indicated by arrow 96, to the first divider wall 92 and/or second divider wall 94. Thus in one extreme example (FIG. 5) a free end 93 of the first divider wall 92 is exactly level with a free end 95 of the second divider wall 94 when viewed along the perpendicular arrow 96. However, in FIGS. 2 and 3 the first divider wall 92 and the second divider wall 94 overlap one another with respect to the direction of the length of the first divider wall 92 or the second divider wall 94. In the example shown in FIGS. 2 and 3 the first divider wall 92 and the second divider wall 94 extend 85% of the chamber's 88 dimension measured along the direction of the length of the first and/or second divider walls 92, 94. Alternatively, the chamber's 88 dimension could be measured in the direction of the centre-line 21. In general, the presently described divider walls may be implemented in other heat shields 60 where the first divider wall 92 and the second divider wall 94 each extend between 10% and 90% across the chamber 88, although advantageously between 15% and 85%, of the chamber in the direction along the length of the first and/or second divider walls 92, 94 although the divider walls must not have a clear line of sight between their ends 93, 95 when viewed perpendicular to one or other of the divider walls 92, 94. Indeed, the first divider wall 92 and second divider 94 wall both extend such that they overlap one another when viewed in a perpendicular direction 96 to at least one of the first divider wall 92 or second divider wall 94. The overlap is greater than 0% and less than 80% of the chamber's extent in the direction of the length of the first and/or second divider walls 92, 94. Advantageously, the overlap is greater than 40% and less than 80% of the chamber's extent in the direction of the length of the first and/or second divider walls 92, 94.

Figure 5:
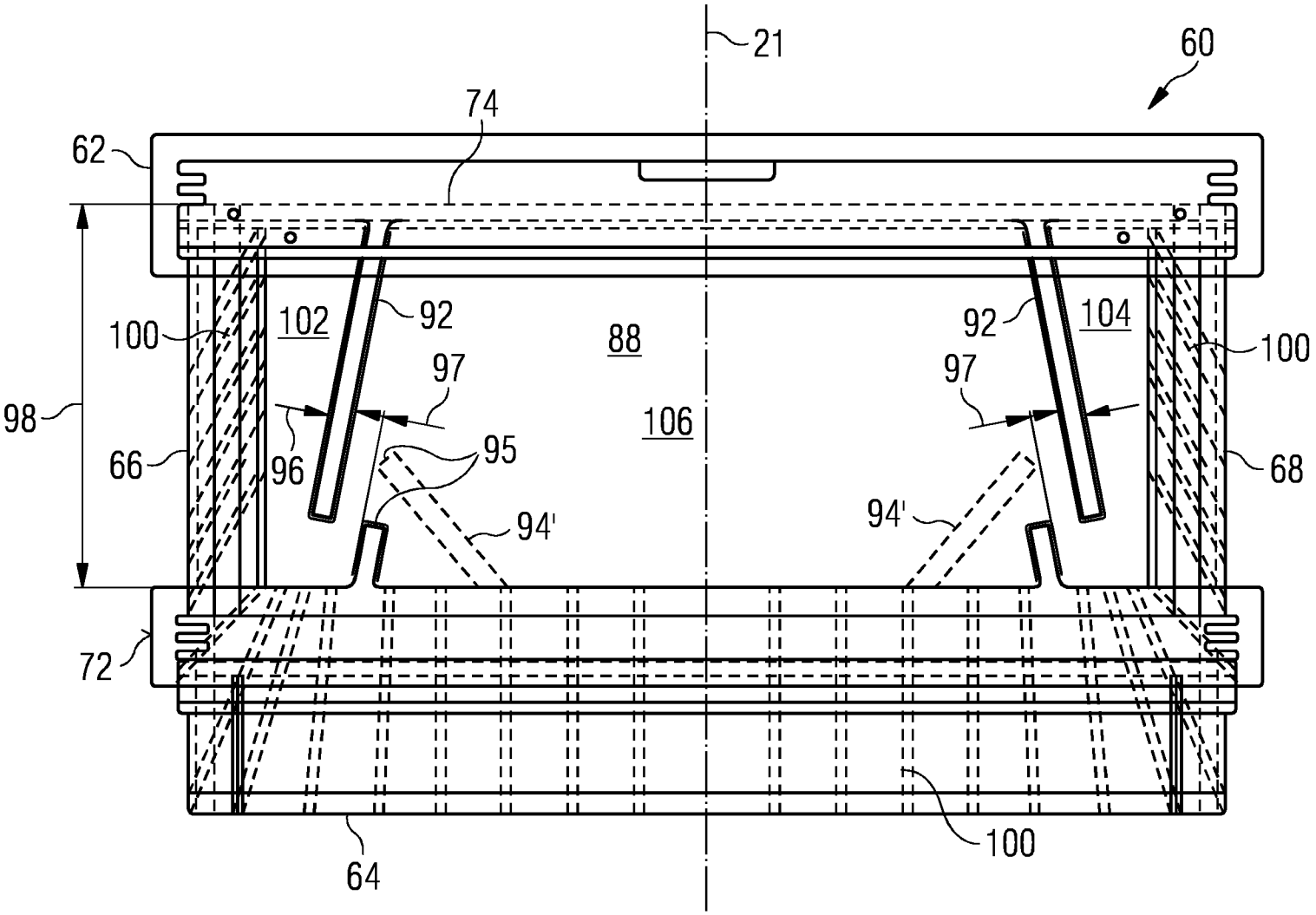
FIG. 5 is a view on a second embodiment of the present heat shield and looking radially inwardly and without the impingement plate.

The first divider wall 92 and the second divider wall 94 are parallel to one another as shown in FIGS. 2, 3, 4 and 5, although the first divider wall 92 and the second divider wall 94 may be angled a with respect to one another and as shown in FIG. 5 by the second divider wall 94' being shown in dashed lines. The first divider wall 92 and second divider wall 94 are spaced apart a distance 97 with respect to the perpendicular direction relative to one of the divider walls. The distance 97 is the minimum distance between the first divider wall 92 and the second divider wall 94. In FIG. 5 the angled second divider wall 94' has its free end 95 a minimum distance 97 away from the first divider wall 92. As shown in FIG. 5, the minimum distance 97 is 10% of the distance 98 between the opposing or facing surfaces of the first wall of the front hook 74 and the wall of the second wall of the rear hook 76. In other embodiments the minimum distance may be between and including 5% and 15% of the distance 98.

The or each pair of divider walls 92, 94 are located within 30% of the (circumferential) length of the upstream wall 74 from a respective lateral edge or end 66, 68. In other words one pair of divider walls 92, 94 is located within 30% of the (circumferential) length of the upstream wall 74 from the left hand lateral end 66 and the other pair of divider walls 92, 94 is located within 30% of the (circumferential) length of the upstream wall 74 from the right hand lateral end 68.

The first divider wall 92 of at least one pair of divider walls is angled a relative to the centre line 21. In FIG. 2 a line 21' is parallel to the centre-line 21 and a centre-line 99 of the first divider wall 92 is shown with the angle α. In the exemplary embodiment of FIG. 2 the angle α is 25° for the first divider wall 92 on the left hand side of the heat shield 60. In other words and with respect to the direction of flow of the working gas 34, the first divider wall 92 is angled away from the centre-line 21. For the right hand side divider wall 92 the angle α is also 25° and here the first divider is also angled away from the centre-line 21 with respect to the direction of the working gas flow 34. However, each pair of divider walls and particularly the first divider wall 92 may be angled anywhere between and including α+25° to −25° from the centre-line 21'. A negative angle indicating that the first divider wall 92 is angled towards the centre-line 21. Advantageously the angle α is between +15° and −15° and most advantageously α is between +15° and 0°.

Referring to FIGS. 2, 3, 4 and 5, the heat shield 60 comprises an array of cooling holes 100, shown as dashed lines, which extend from the chamber 88 to the lateral sides 66, 68 and the downstream side or trailing edge 64. The chamber 88 is divided into three main zones or sub-chambers, two lateral zones 102, 104 and a central zone 106. The two lateral zones 102, 104 are each located either side of the central zone 106 and are laterally outside of the central zone 106 with respect to the centre-line 21. The cooling holes 100A, 100B that extend from the lateral zones 102, 104 respectively mostly extend to the lateral sides 66, 68 respectively and the cooling holes 100C that extend from the central chamber 106 extend to the trailing edge 64 of the heat shield 60.

Lateral gaps that extend axially exists between circumferentially adjacent heat shields 60 and a circumferential gap exists between the trailing edge 64 and other immediately downstream adjacent structure. These gaps can allow ingestion of hot working gases which is not desirable and would otherwise lead to thermal degradation of the heat shield 60. Gas pressure in the lateral gaps can often be higher than the gas pressure in the circumferential gap. To prevent ingestion of hot gases into these gaps coolant is supplied to the gaps via the cooling holes 100A, B, C. In addition, the coolant passing through the cooling holes 100A, B, C also cools the material of the heat shield 60. Often there are different requirements for sealing the gaps and cooling of the lateral sides and trailing edge regions. For the examples in FIGS. 2, 3, 4, and 5 the lateral regions and sides 66, 68 are subject to a greater coolant requirement than the trailing edge 64. Thus it is desirable to have greater mass flow of coolant per unit of area or length flowing through the cooling holes 100 that extend to the lateral edges 66, 68 than to those that extend to the trailing edge 64 from the central zone 106. The greater coolant requirement to the lateral sides is achieved by virtue of a higher density of cooling holes 100 that extend to the lateral edges 66, 68 than the trailing edge 64. However, in other embodiments the greater coolant requirement to the lateral sides 66, 68 may be achieved by virtue of large diameter cooling holes or higher pressure coolant feeding into the cooling holes 100A, 100B from the lateral chambers 102, 104 than the pressure in the central chamber 106. Furthermore, any implementation may comprise any one or more of higher density cooling holes, larger cooling hole diameter and higher pressure feed to the cooling holes 100A, 100B that extend to the lateral edges 66, 68 than the cooling holes 100C.

In addition to the cooling holes 100, further cooling of the heat shield 60 is achieved by impingement cooling jets formed by the coolant passing through the impingement plate's 86 impingement holes 90. A coolant supply provides pressurised coolant radially outwardly of the impingement plate 86. Coolant passes through the impingement holes 90 and impinges on the second surface 72 of the main body of the heat shield 60, thereby removing heat from the material of the heat shield 60. The impingement holes 90 are arranged to provide sufficient cooling to parts of the second surface 72 so that a more constant temperature gradient is achieved over the heat shield 60. A more constant temperature gradient reduces thermal stresses and increases the life of the component. In addition, the impingement cooling will reduce the absolute temperature of the component thereby reducing oxidation and therefore thermal degradation.

As described earlier the chamber 88 is divided into three zones, lateral zones 102, 104 and central zone 106. The density of the impingement holes 90A, 90B feeding coolant directly into lateral zones 102, 104 are greater than the density of impingement holes 90C that feed directly into the central zones 106. As mentioned above the impingement holes 90 that feed coolant directly into the lateral chambers 102, 104 may be greater in diameter instead or as well as having a greater density that the impingement holes 90C. The coolant flow, which is directed through the impingement cooling holes 90C into the central zone or chamber 106, may increase the pressure in the lateral zones or chambers 102, 104 by overflowing with coolant the trailing edge holes 100 in the lateral zones or chambers 102, 104. The reduced mass flow of coolant flowing through the impinging holes 90A, 90B which feed directly into the lateral chambers 102,104 decreases the pressure drops along the lateral holes 100A, 100B and will increase the pressure of the coolant. In this way the lateral holes 100A, 100B are suitably pressurised to prevent hot gas ingestion. In particular the coolant flow through the impingement holes 90A, 90B in the lateral chambers 102, 104 is constrained in the lateral chamber 102, 104 and is directed to flow through the lateral holes 100 by increasing the mass flow in the lateral chambers 102,104.

The lateral zones 102, 104 and the central zones 106 are separated by the pairs of divider walls 92, 94. As mentioned previously the divider walls 92, 94 of each pair are spaced apart a distance 97 to allow an amount of coolant to flow from one zone to another, thus there is some distribution of pressure which is advantageous particularly during transient operating conditions to better balance the cooling requirements with the working gas temperatures variations.

Impingement holes 90 may be provided between the divider walls 92, 94 to allow an impingement jet to impingement on the surface 72 between the divider walls 92, 94. The amount of coolant allowed to flow through these impingement holes may be designed further reduce or minimise the temperature gradient across the heat shield 60 and to assist in pressurizing the lateral and or central chambers accordingly.

The invention claimed is:

1. A heat shield for a gas turbine engine, the heat shield comprising:

a main body having a first surface and a second surface, the first surface being exposed to a hot working gas, a plurality of walls upstanding from the second surface, and an impingement plate, wherein the impingement plate is attached to at least one wall of the plurality of walls and forms a chamber with the second surface and the plurality of walls and wherein the impingement plate comprises an array of impingement holes, at least one pair of divider walls comprising a first divider wall and a second divider wall formed within the chamber and extending between the impingement plate and the second surface, wherein the first divider wall has a length, the length extends from a first wall of the plurality of walls towards a second wall, the second wall opposing the first wall, the second divider wall having a length that extends from the second wall towards the first wall, wherein the first divider wall and the second divider wall both extend such that each divider wall overlaps one another when viewed in a perpendicular direction to the length of first divider wall and/or the second divider wall, and wherein the first divider wall and the second divider wall are spaced apart with respect to the perpendicular direction, wherein a length of the overlap is greater than 0% and less than 80% of a length of the chamber in a direction of the length of the first divider wall and/or the second divider wall, and wherein the first divider wall and the second divider wall each extend a full distance from the impingement plate to the second surface such that there are no gaps between the impingement plate and the second surface along the length of the first divider wall as the first divider wall extends from the impingement plate to the second surface, and wherein there are no gaps between the impingement plate and the second surface along the length of the second divider wall as the second divider wall extends from the impingement plate to the second surface.

2. The heat shield as claimed in claim 1, wherein the first divider wall is attached to the impingement plate or the second surface and/or the second divider wall is attached to the impingement plate or the second surface.

3. The heat shield as claimed in claim 1, wherein the length of the first divider wall and the length of the second divider wall each extend between 10% and 90% of the length of the chamber in the direction of the length of the first divider wall and the second divider wall.

4. The heat shield as claimed in claim 1, wherein the length of the overlap is greater than 40% and less than 80% of the length of the chamber in the direction of the length of the first divider wall and/or the second divider wall.

5. The heat shield as claimed in claim 1, wherein the first divider wall and the second divider wall are parallel to one another.

6. The heat shield as claimed in claim 1, wherein the first divider wall and the second divider wall are angled at an angle (a) with respect to one another.

7. The heat shield as claimed in claim 1, wherein the heat shield comprises two pairs of divider walls.

8. The heat shield as claimed in claim 1, wherein one of the plurality of walls is an upstream wall having lateral ends and one of the first divider wall and the second divider wall extends from the upstream wall, wherein the at least one pair of divider walls is located within 30% of a length of the upstream wall from one or each of the lateral ends of the upstream wall.

9. The heat shield as claimed in claim 1, wherein the at least one pair of divider walls divide the chamber into at least a first lateral zone and a central zone, wherein the array of impingement holes has at least a first set of impingement holes opening into the first lateral zone and a second set of impingement holes opening into the central zone, wherein the first set of impingement holes has a different arrangement of impingement holes compared to the second set of impingement holes, the different arrangement of impingement holes provides a different cooling effect.

10. The heat shield as claimed in claim 9, wherein the plurality of walls has at least one lateral wall and wherein the first lateral zone is located immediately adjacent to the lateral wall and the first lateral zone occupies up to 25% of the second surface within the chamber.

11. The heat shield as claimed in claim 9, wherein a second pair of divider walls divides the chamber into a second lateral zone, wherein the array of impingement holes has a third set of impingement holes opening into the second lateral zone, and wherein the third set of impingement holes has a different arrangement of impingement holes compared to at least the second set of impingement holes, the different arrangement of impingement holes provides a different cooling effect.

12. The heat shield as claimed in claim 9, wherein the different arrangement of impingement holes comprises any one at least one of a different density of impingement holes and a different cross-sectional area of impingement holes.

13. The heat shield as claimed in claim 9, wherein the heat shield has a centre line, wherein at least one divider wall of the at least one pair of divider walls is angled at an angle ($\alpha$) relative to the centre line.

14. The heat shield as claimed in claim 1, wherein the heat shield is at least a part of at least one component of turbomachinery: a circumferential segment or a blade outer air seal (BOAS), a shroud of a turbine, a tile or a heat shield of a wall of a combustor, a platform or shroud of a blade or vane.

15. The heat shield as claimed in claim 3, wherein the length of the first divider wall and the length of the second divider wall each extend between 15% and 85% of the length of the chamber in the direction of the length of the first divider wall and the second divider wall.

16. The heat shield as claimed in claim 13, wherein the angle $\alpha$ is between +25° and −25°.

17. The heat shield as claimed in claim 13, wherein the angle $\alpha$ is between +15° and −15°.

18. The heat shield as claimed in claim 13, wherein the angle $\sigma$ is between +15° and 0°.

* * * * *